US006183204B1

(12) United States Patent
Chang

(10) Patent No.: US 6,183,204 B1
(45) Date of Patent: Feb. 6, 2001

(54) ELECTRIC FAN WITH DESK FAN/FLOOR FAN DUAL-MODE

(75) Inventor: Antony Chang, Taisan Taipei (TW)

(73) Assignee: Accutek Products Corp., Taipei (TW)

( * ) Notice: Under 35 U.S.C. 154(b), the term of this patent shall be extended for 0 days.

(21) Appl. No.: 09/385,456

(22) Filed: Aug. 30, 1999

(51) Int. Cl.[7] ..... B63H 7/00
(52) U.S. Cl. ..... 416/246; 416/244 R
(58) Field of Search ..... 416/244 R, 246, 416/247 R, 204, 205; 415/213.1, 121.2, 126

(56) References Cited

U.S. PATENT DOCUMENTS 5,403,162 * 4/1995 Chen ..... 416/246
5,411,373 * 5/1995 Chiu et al. ..... 416/246
6,015,262 * 1/2000 Huang ..... 416/100

* cited by examiner

*Primary Examiner*—Edward K. Look
*Assistant Examiner*—Ninh Nguyen
(74) *Attorney, Agent, or Firm*—Donald C. Casey, Esq.

(57) ABSTRACT

An electric fan, which includes a saucer-like base for positioning on a flat surface, a floor fan connector for fastening to the base, a fan assembly, the fan assembly having a downwardly extended bottom coupling tube and a peg raised from the periphery of the bottom coupling tube, a stem for connection between the fan assembly and the floor fan connector, enabling the fan assembly and the base to be assembled into a floor fan, a lock screw for threading into a screw hole at the peg of the bottom coupling tube to secure the fan assembly to the stem, a lock nut for threading onto an outer thread at the stem to secure the stem to the floor fan connector and the base, and a desk fan connector for fastening the bottom coupling tube of the fan assembly to the base, enabling the fan assembly and the base to be assembled into a desk fan.

1 Claim, 7 Drawing Sheets

ELECTRIC FAN WITH DESK FAN/FLOOR FAN DUAL-MODE

BACKGROUND OF THE INVENTION

The present invention relates to electric fans for home use, and more particularly to such an electric fan that can be alternatively arranged into a desk fan, or a floor fan as desired.

Regular electric fans for home use commonly include two types, namely, the floor fans and the desk fans. A desk fan, as shown in FIG. 1A, is generally comprised of a fan assembly 10, and a stand 20. A floor fan, as shown in FIG. 1B, is generally comprised of a fan assembly 10, a stand 20, and a retractable stem 30 connected between the fan assembly 10 and the stand 20. A desk fan is compact and portable, and designed for use on the top of a table or the like, however it is not suitable for use in the living room or lobby, or a spacious floor space. A floor fan is heavy and not portable, however it is suitable for use in a spacious space. Because these two types of electric fans are designed for different purposes, it is expensive to prepare two different types electric fans. Because the stands for desk fans and the stands for floor fans are not compatible, the inventory control in factory is complicated.

SUMMARY OF THE INVENTION

The present invention has been accomplished under the circumstances in view. It is the main object of the present invention to provide an electric fan, which can be alternatively arranged into a desk fan, or a floor fan as desired. According to the present invention, the electric fan comprises a saucer-like base for positioning on a flat surface, a floor fan connector for fastening to the base, a fan assembly, the fan assembly having a downwardly extended bottom coupling tube and a peg raised from the periphery of the bottom coupling tube, a stem for connection between the fan assembly and the floor fan connector, enabling the fan assembly and the base to be assembled into a floor fan, a lock screw for threading into a screw hole at the peg of the bottom coupling tube to secure the fan assembly to the stem, a lock nut for threading onto an outer thread at the stem to secure the stem to the floor fan connector and the base, and a desk fan connector for fastening the bottom coupling tube of the fan assembly to the base, enabling the fan assembly and the base to be assembled into a desk fan.

DETAILED DESCRIPTION OF THE PREFERRED EMBODIMENT

Figure 1B:
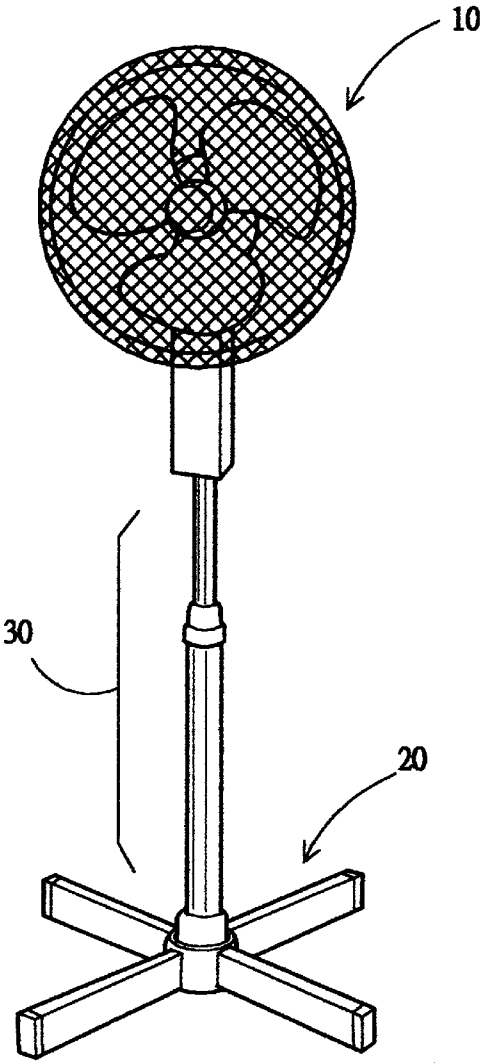
FIG. 1(B) PRIOR ART
FIG. 1B is a perspective view of a conventional floor fan.
Figure 1A:
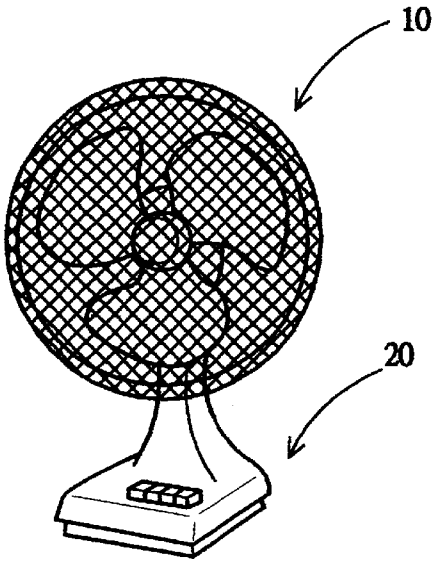
FIG. 1(A) PRIOR ART
FIG. 1A is a perspective view of a conventional desk fan.
Figure 2:
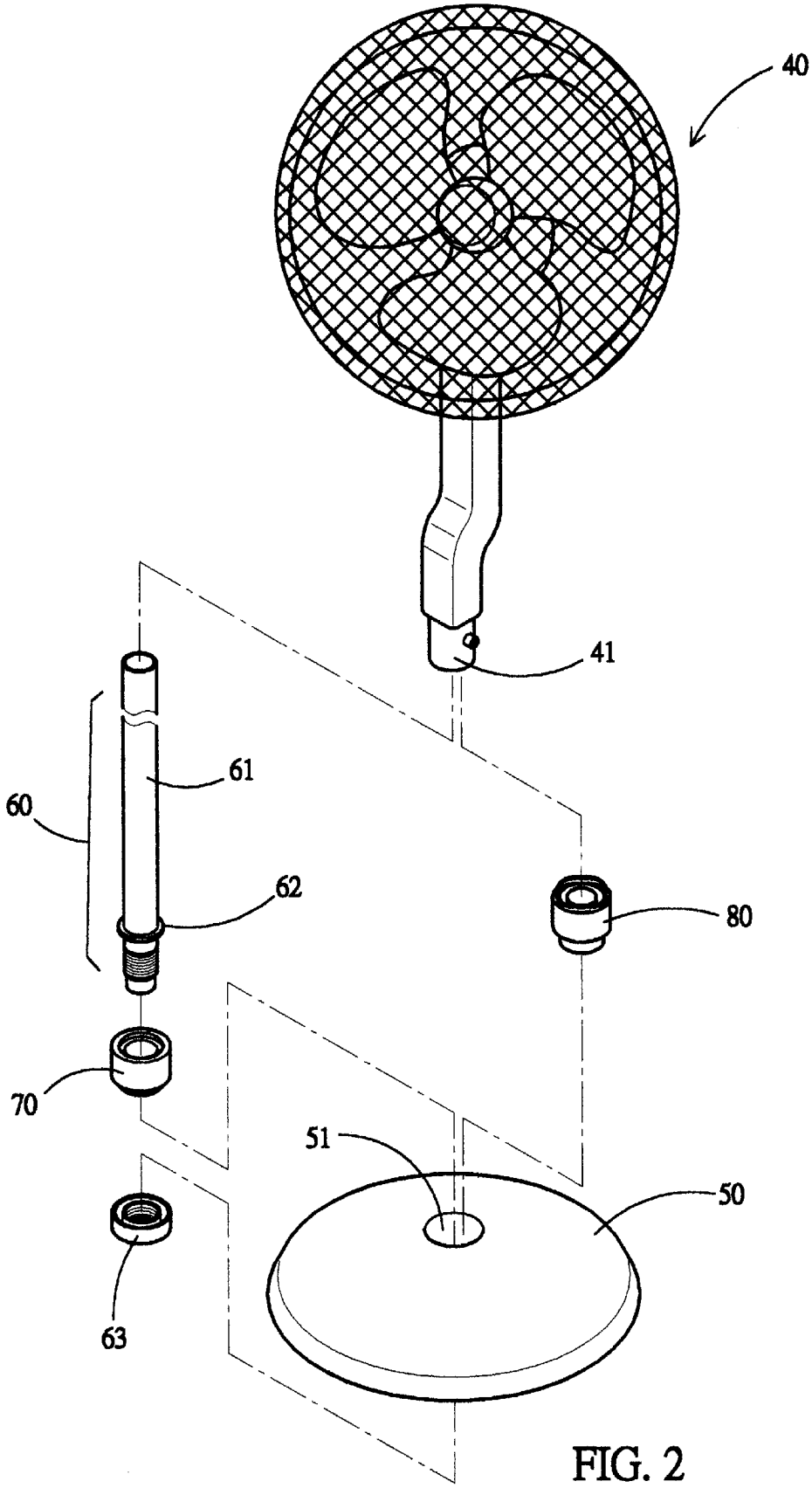
FIG. 2 is an exploded view of an electric fan according to the present invention.
Figure 3:
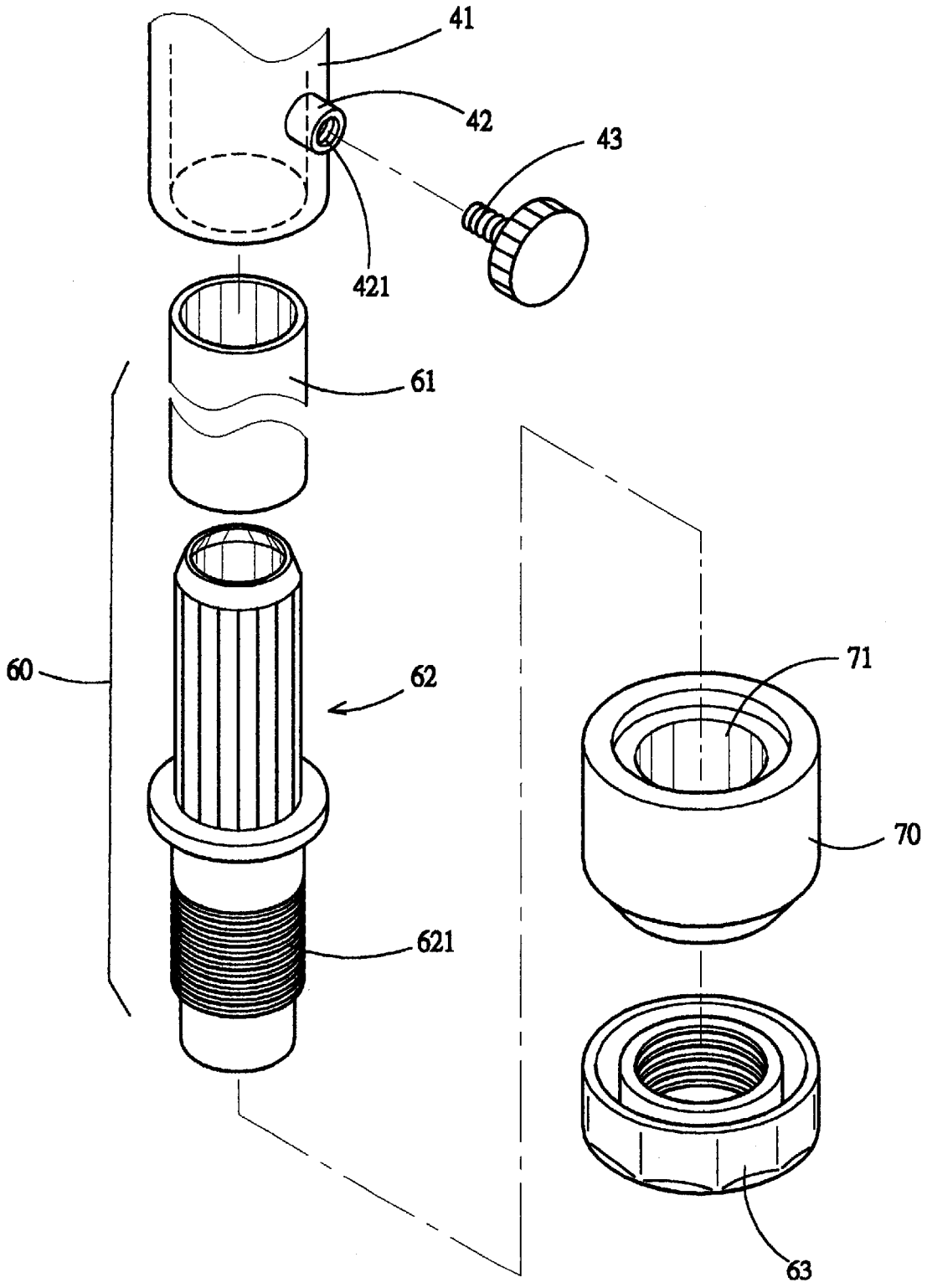
FIG. 3 is an enlarged view of a part of the present invention.

Referring to FIGS. 2 and 3, an electric fan in accordance with the present invention is shown comprised of a fan assembly 40, a base 50, a stem 60, a floor fan connector 70, and a desk fan connector 80.

Figure 5A:
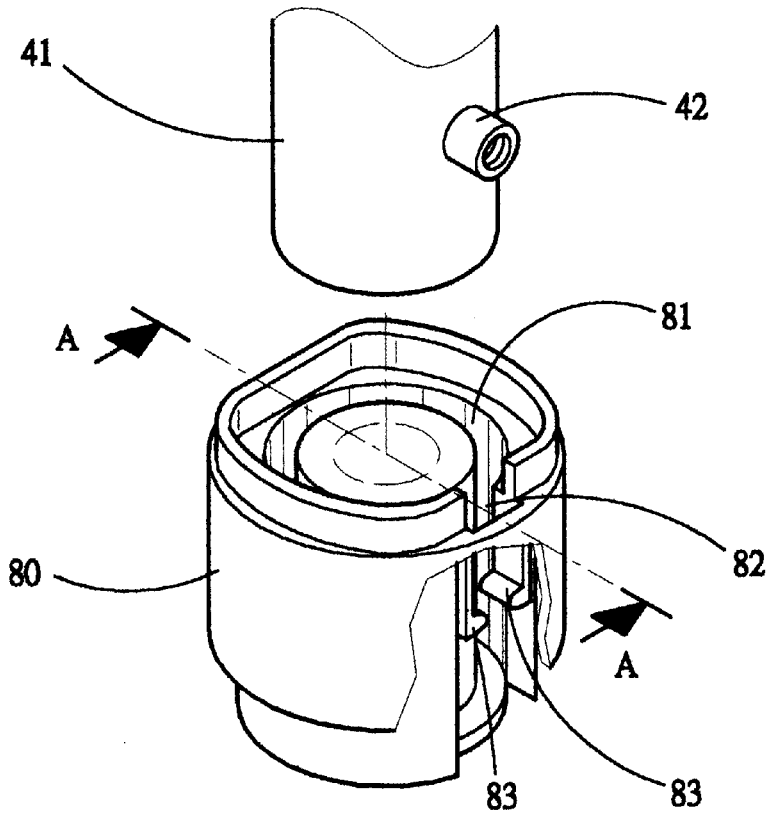
FIG. 5A is an enlarged view of a part of the present nvention, showing the structure of the desk fan connector.
Figure 5B:
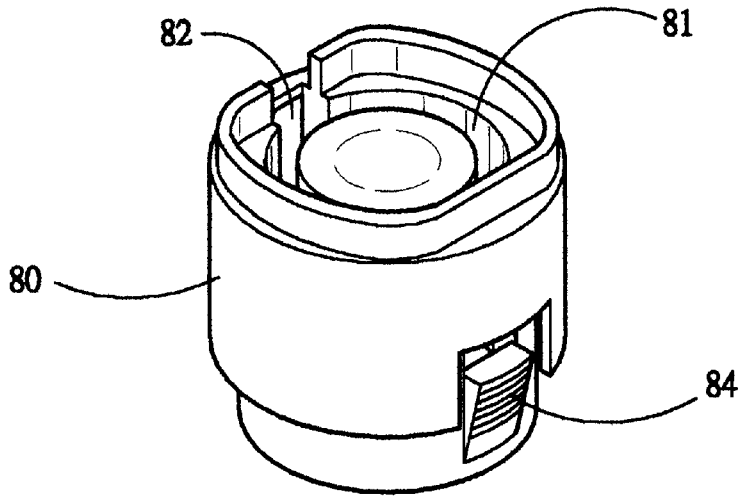
FIG. 5B is another perspective view of the desk fan onnector shown in FIG. 5A when viewed from another angle.
Figure 5C:
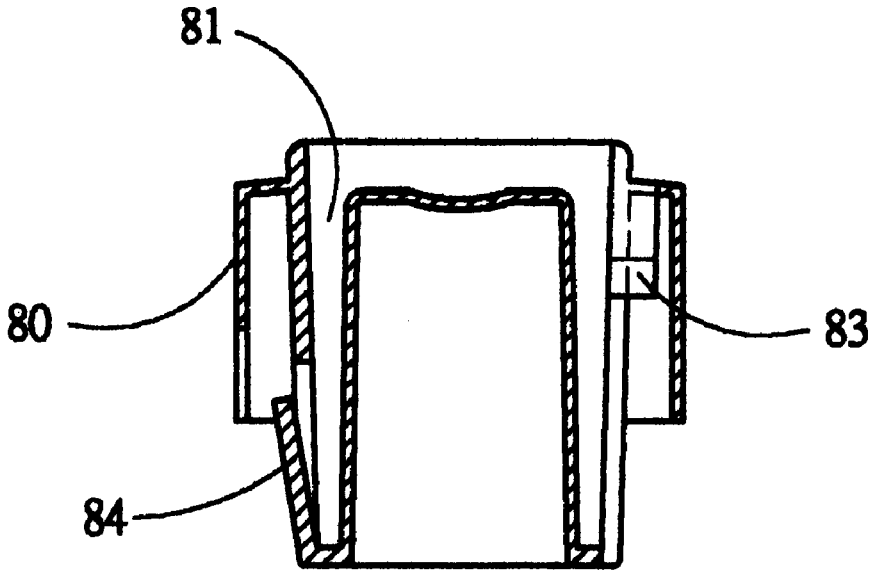
FIG. 5C is a sectional view taken along line 5—5 of FIG. 5A.

Referring to FIGS. 5A and 5B and FIGS. 2 and 3 again, the fan assembly 40 is of the known structure comprised of a flan blade, a fan motor, a guard, and a driving control circuit means. The fan assembly 40 comprises a downwardly extended bottom coupling tube 41, a peg 42 raised from the periphery of the bottom coupling tube 41, and a screw hole 411 at the peg 42. The base 50 is shaped like a saucer, and designed for positioning on the floor stably, having a locating hole 51 at the center of the top side wall thereof for the positioning of the floor fan connector 70, or the desk fan connector 80. The stem 60 is comprised of a metal sleeve 61, and an inner tube 62. The metal sleeve 61 can be made of a fixed tube, or a retractable tube. The inner tube 62 has one end inserted into the metal sleeve 61, and an opposite end terminating in an outer thread 621. The floor fan connector 70 is a hollow cylindrical member fitting the locating hole 51 at the base 50, having an axially extended center through hole 71. The desk fan connector 80 is a hollow cylindrical member fitting the locating hole 51 at the base 50, comprising an endless coupling groove 81 at the top side thereof, a longitudinal locating groove 82 at one side of the endless coupling groove 81, two inner hooks 83 at two opposite sides of the longitudinal locating groove 82, and an outer hook 84 near the bottom side thereof.

The fan assembly 40, the stem 60, the floor fan connector 70 and the base 50 can be assembled together, forming a floor fan. Alternatively, the fan assembly 40, the desk fan connector 80 and the base 50 can be assembled together, forming a desk fan.

Figure 4:
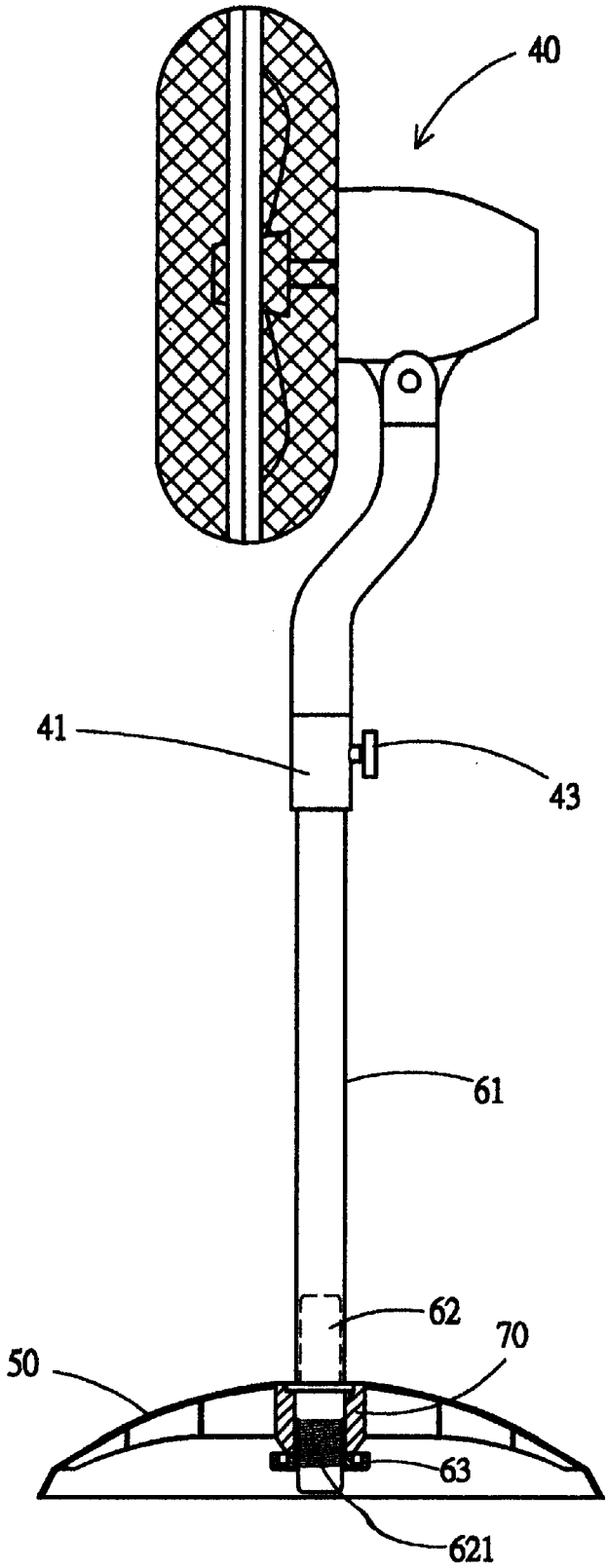
FIG. 4 shows the present invention arranged into a floor fan.

Referring to FIG. 4 and FIG. 3 again, the floor fan connector 70 is mounted in the locating hole 51 at the base 50, then the inner tube 62 is inserted into the center through hole 71 at the floor fan connector 70, and then a lock nut 63 is threaded onto the outer thread 621 to fix the inner tube 62 and the floor fan connector 70 to the base 50, and then the metal sleeve 61 is sleeved onto the inner tube 62 and inserted into the bottom coupling tube 41 of the fan assembly 40, and then a screw 43 is threaded into the screw hole 421 at the peg 42 to fix the metal sleeve 61 to the bottom coupling tube 41. Thus, a floor fan is set up.

Figure 6:
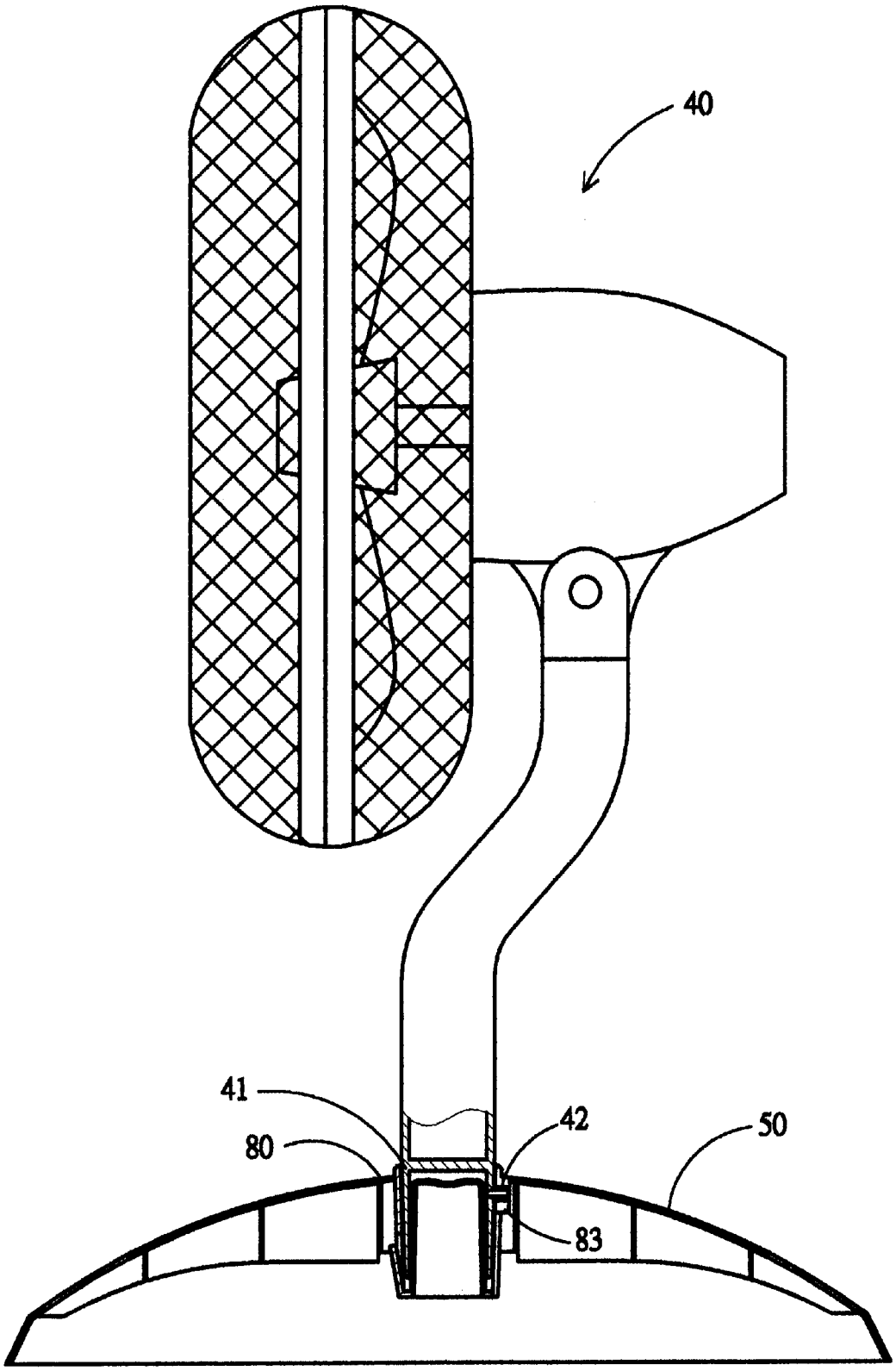
FIG. 6 shows the present invention arranged into a desk fan.

Referring to FIG. 6 and FIGS. from 5A through 5C, the desk fan connector 80 is inserted into the locating hole 51 at the base 50, enabling the outer hook 84 to be hooked up with an inside wall of the base 50 to secure the desk fan connector 80 to the base 50, then the bottom coupling tube 41 of the fan assembly 40 is inserted into the endless coupling groove 81 at the desk fan connector 80, enabling the peg 42 to be engaged into the longitudinal locating groove 82, and retained in place by the inner hooks 83. Thus, a desk fan is set up.

As indicated above, the present invention provides an electric fan that can be alternatively arranged into a desk fan or a floor fan as desired.

While only one embodiment of the present invention has been shown and described, it will be understood that various modifications and changes could be made thereunto without departing from the spirit and scope of the invention disclosed.

What the invention claimed is:

1. An electric fan kit comprising:

a base shaped like a saucer for positioning on a flat surface, said base comprising a locating hole at the center of a top sidewall thereof;

a floor fan connector for fastening to the locating hole at said base, said floor fan connector comprising an axially extended center through hole;

a fan assembly, said fan assembly comprising a downwardly extended bottom coupling tube, a peg raised from the periphery of said bottom coupling tube, and a screw hole at said peg;

a stem for connection between said fan assembly and said floor fan connector, said stem comprising an inner tube, and a metal sleeve sleeved onto said inner tube, said metal sleeve being sleeved onto said inner tube for insertion into the bottom coupling tube of said fan assembly, said inner tube having an outer thread at one end thereof for fastening to said floor fan connector and said base;

a lock screw for threading into the screw hole at said peg of said bottom coupling tube of said fan assembly to secure said fan assembly to the metal sleeve of said stem;

a lock nut for threading onto the outer thread of said inner tube of said stem to secure said stem to said floor fan connector and said base; and a desk fan connector for fastening said fan assembly to said base, said desk fan connector comprising an endless coupling groove at a top side thereof for receiving the bottom coupling groove of said fan assembly, a longitudinal locating groove at one side of said endless coupling groove for receiving the peg of said bottom coupling tube of said fan assembly, two inner hooks disposed at two opposite sides of said longitudinal locating groove for securing the peg of said bottom coupling tube of said fan assembly to said desk fan connector, and an outer hook disposed near a bottom side thereof for securing said desk fan connector to the locating hole in said base.

* * * * *